US007841903B2

(12) United States Patent
Saito

(10) Patent No.: US 7,841,903 B2
(45) Date of Patent: Nov. 30, 2010

(54) ADAPTOR AND WIRELESS COMMUNICATION MODULE

(75) Inventor: Shinya Saito, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 381 days.

(21) Appl. No.: 11/892,604

(22) Filed: Aug. 24, 2007

(65) Prior Publication Data

US 2008/0050971 A1 Feb. 28, 2008

(30) Foreign Application Priority Data

Aug. 28, 2006 (JP) ..... 2006-231185

(51) Int. Cl.
*H01R 25/00* (2006.01)

(52) U.S. Cl. ..... 439/638

(58) Field of Classification Search ..... 439/638, 439/650, 651, 654; 455/554.2, 557
See application file for complete search history.

(56) References Cited

U.S. PATENT DOCUMENTS

| | | | | |
|---|---|---|---|---|
| 3,535,638 | A * | 10/1970 | Michelin | 324/149 |
| 5,836,783 | A * | 11/1998 | Morisawa et al. | 439/502 |
| 6,007,372 | A * | 12/1999 | Wood | 439/502 |
| 6,255,800 | B1 * | 7/2001 | Bork | 320/115 |
| 6,612,874 | B1 * | 9/2003 | Stout et al. | 439/640 |
| 6,790,094 | B1 * | 9/2004 | Bergmann et al. | 439/653 |
| 7,212,420 | B2 * | 5/2007 | Liao | 363/146 |
| 7,419,393 | B2 * | 9/2008 | Milan | 439/171 |
| 7,513,038 | B2 * | 4/2009 | Koh | 29/854 |
| 7,519,392 | B2 * | 4/2009 | Kwak | 455/554.2 |
| 2006/0161716 | A1 * | 7/2006 | Lin | 710/313 |
| 2006/0194467 | A1 * | 8/2006 | Beasley et al. | 439/339 |
| 2007/0032098 | A1 * | 2/2007 | Bowles et al. | 439/11 |
| 2007/0099466 | A1 * | 5/2007 | Gushiken | 439/188 |
| 2009/0228614 | A1 * | 9/2009 | Hwang | 710/16 |
| 2010/0162011 | A1 * | 6/2010 | Min | 713/300 |

FOREIGN PATENT DOCUMENTS

| | | | |
|---|---|---|---|
| CN | 1435987 | A | 8/2003 |
| JP | 2002-149285 | A | 5/2002 |
| JP | 3097777 | | 8/2003 |
| JP | 2005-275822 | A | 10/2005 |
| WO | WO 2006/076274 | A1 | 7/2006 |

OTHER PUBLICATIONS

Derwint 2004-798240 Connecting device for linking a wireless/radio telephone Dated 2009.*

* cited by examiner

*Primary Examiner*—Neil Abrams
(74) *Attorney, Agent, or Firm*—McGinn IP Law Group, PLLC

(57) ABSTRACT

An adaptor according to an embodiment of the present invention includes: a power supply line to be connected to an external power supply; a first connector including a plurality of terminals; and a second connector including a first terminal connected to at least one of the plurality of terminals of the first connector and a second terminal connected to the power supply line. The adaptor realizes the connection between an external device and a wireless USB module.

14 Claims, 8 Drawing Sheets

ADAPTOR AND WIRELESS COMMUNICATION MODULE

BACKGROUND OF THE INVENTION

1. Field of the Invention

The present invention relates to an adaptor interposed between devices, and to a wireless communication module.

2. Description of Related Art

Along with advances in computer technologies, a performance of an external device (such as printer, an input device, a HDD (Hard Disk Drive), or the like) has been enhanced. The computer and the external device are connected together through a communication cable conforming to a corresponding data communication standard. Many data communication standards have been hitherto proposed. In particular, a USB (Universal Serial Bus)-compliant connection system of the external device has been widely employed.

Incidentally, the communication cable is not always necessary for a user although being necessary for connecting devices. This is because the communication cable would be an obstacle to improvements in portability and simplicity of a device.

A connector shape, layout of terminals, and terminal functions are prescribed by the data communication standards. Some of the data communication standards do not stipulate that a connector should be furnished with a power supply input terminal. If no power is supplied from a main apparatus to a wireless communication module, a power supply or a power cable should be additionally provided to the wireless communication module. In such cases, usability of the wireless communication module is lowered.

For example, Japanese Utility Model Registration Application No. 2003-2702 discloses a relay connector for connecting between an external device and a main apparatus based on serial ATA standards. In the relay connector conforming to the serial ATA standards, a signal section and a power supply section are physically separated. The signal section and the power supply section are fixed to each other by means of a bonding member but are not physically configured as one terminal. The power supply section only outputs power supplied from the external device based on the serial ATA standards. Hence, a power supply should be additionally provided to the external device as before. In short, power cannot be supplied from a main body to the external device through the power supply section of the relay connector.

As described above, in the wireless communication module of the related art, if the data communication standard and the like disallow power supply from the main apparatus, a power supply unit should be additionally provided to the wireless communication module, and usability of the wireless communication module is lowered.

Incidentally, a connector shape or the like varies depending on data communication standards. However, in general, a predetermined development period is necessary to change the connector shape or the like. Thus, the connector specifications could not be changed as soon as the data communication standard is changed.

SUMMARY

In one embodiment, an adaptor to be interposed between a first device and a second device, the adaptor includes a power supply line to be connected to an external power supply; a first connector including a plurality of terminals; and a second connector including a first terminal connected to at least one of the plurality of terminals of the first connector and a second terminal connected to the power supply line.

In another embodiment, a wireless communication module includes a communication module to communicate with a first device by radio; and an adaptor to connect the communication module with a second device, the adaptor comprises a power supply line to be connected to an external power supply; a first connector including a plurality of terminals and to be connected to the second device; and a second connector to be connected to the communication module, the second connector including a first terminal connected to at least one of the plurality of terminals of the first connector and a second terminal connected to the power supply line.

In still another embodiment, an adaptor to be interposed between a first device and a communication module to enable signal transmission between the first device and the communication module, the adaptor comprises a power supply line to be connected to an external power supply; a first connector including a plurality of terminals and to be connected to a first device; and a second connector to be connected to the communication module, the second connector including a first terminal connected to at least one of the plurality of terminals of the first connector and a second terminal connected to the power supply line According to the above embodiments, power is transferable to an external device (the first device or the second device) through the second terminal included in the second connector. And, usability such as portability of the external device can be improved.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

First Embodiment

Figure 1:
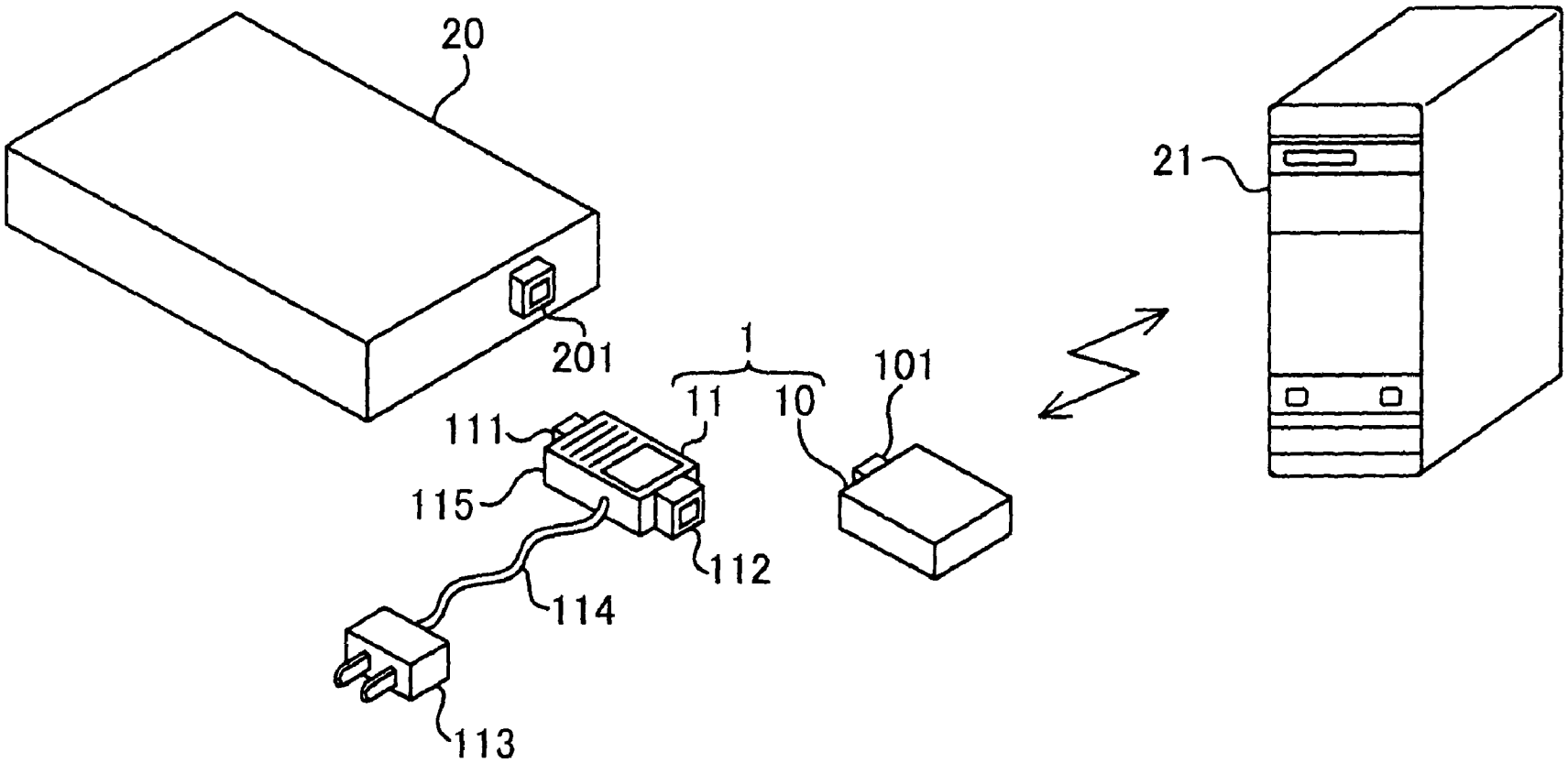
FIG. 1 is a schematic perspective view of an outer appearance of a data-communication adaptor according to a first embodiment to the present invention.
Figure 2:
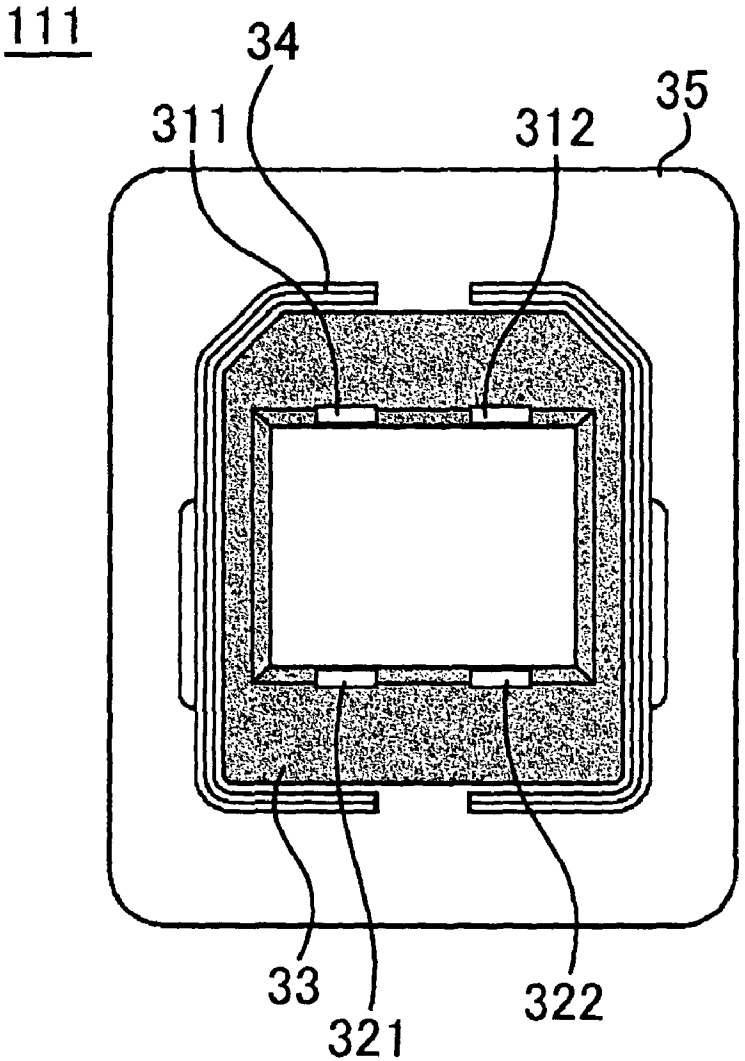
FIG. 2 is a schematic plan view of a connector of the data-communication adaptor of the first embodiment.
Figure 3:
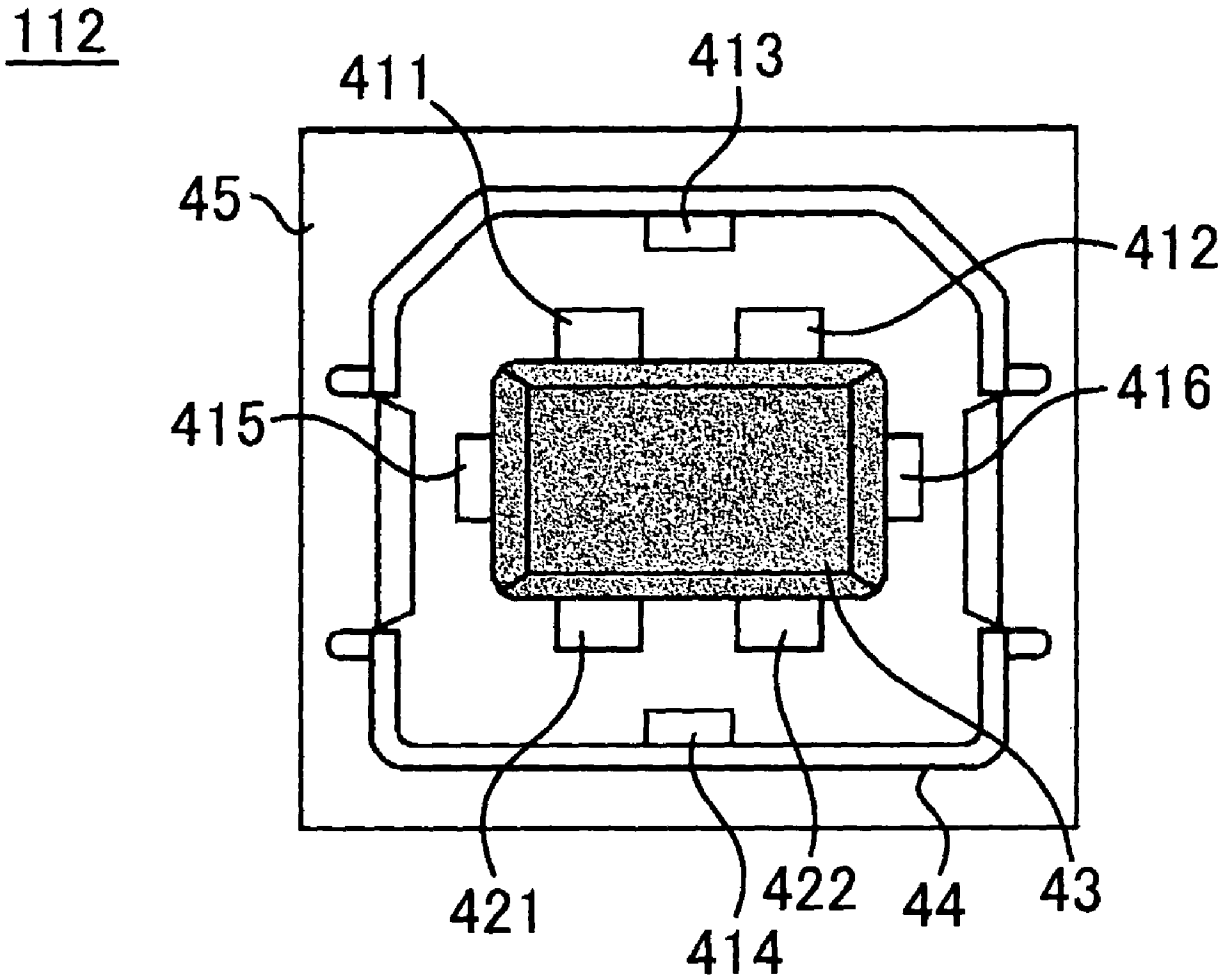
FIG. 3 is a schematic plan view of the connector of the data-communication adaptor of the first embodiment.
Figure 4:
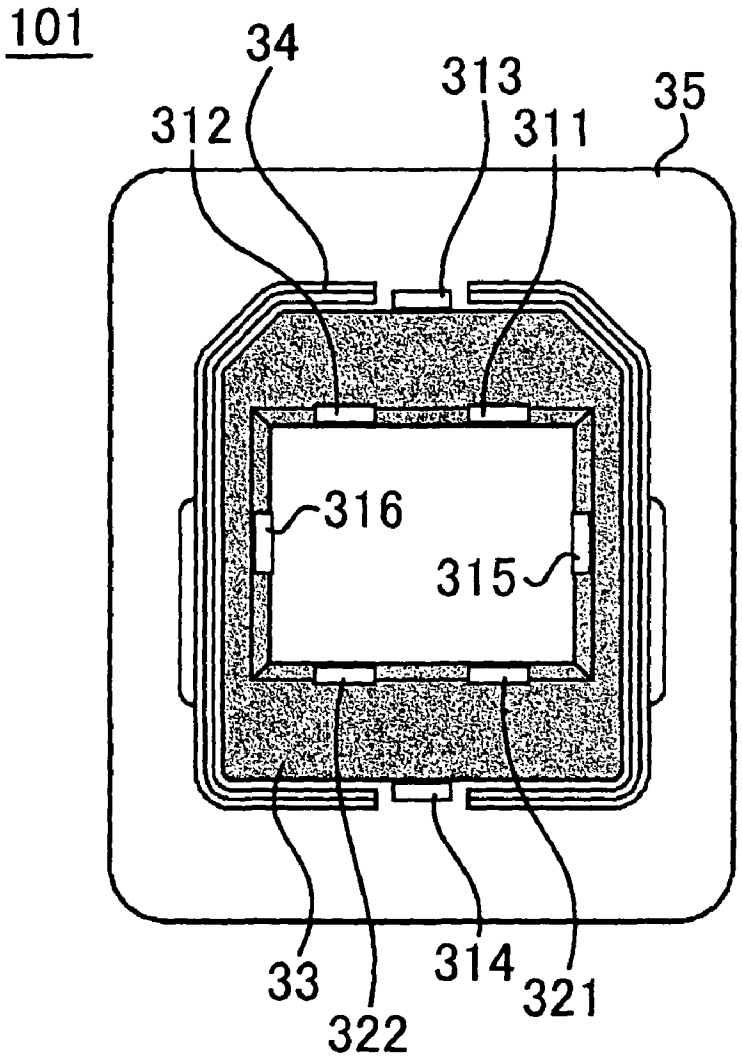
FIG. 4 is a schematic plan view of a connector of an external device of the first embodiment.
Figure 5:
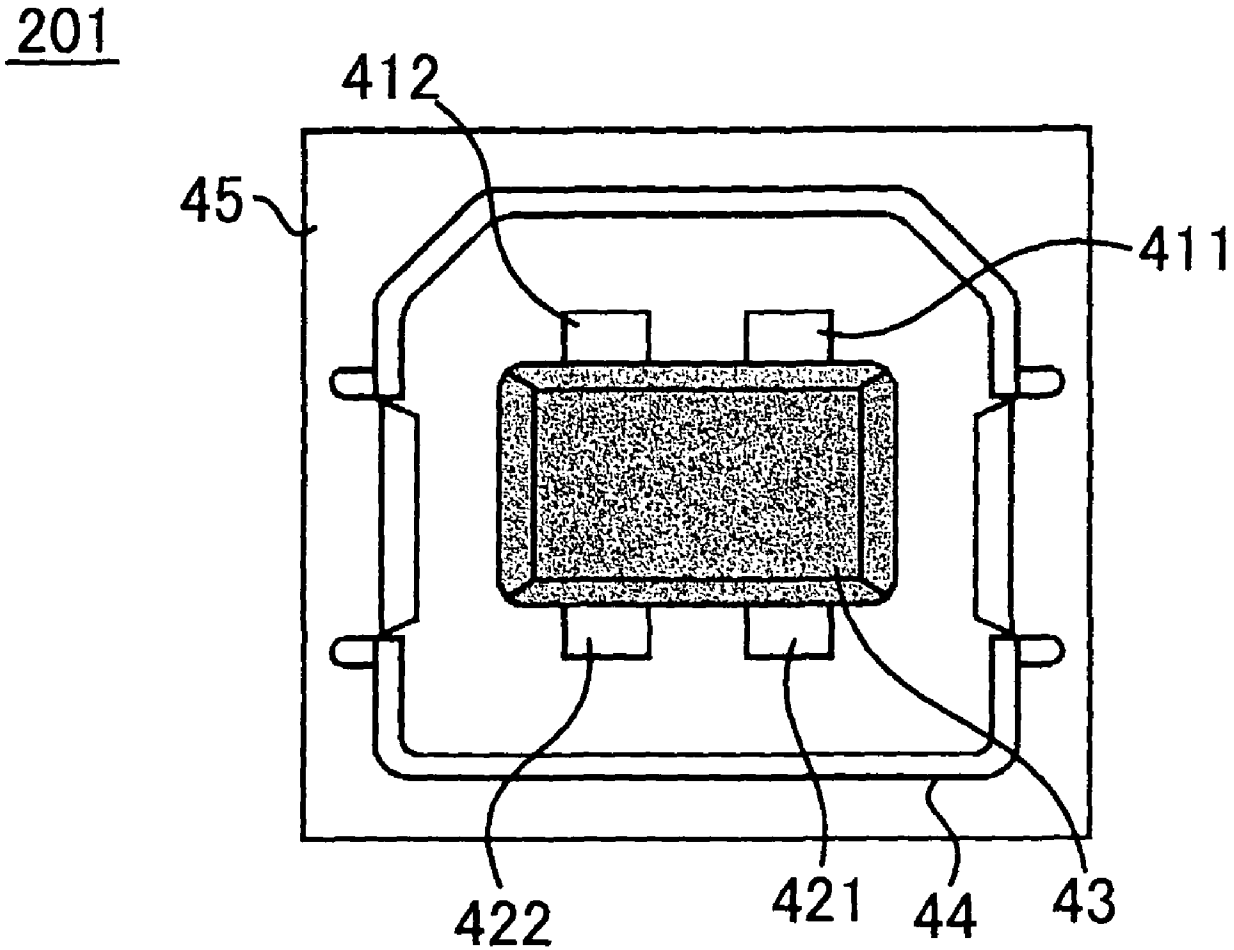
FIG. 5 is a schematic plan view of a connector of a wireless communication module of the first embodiment.
Figure 6:
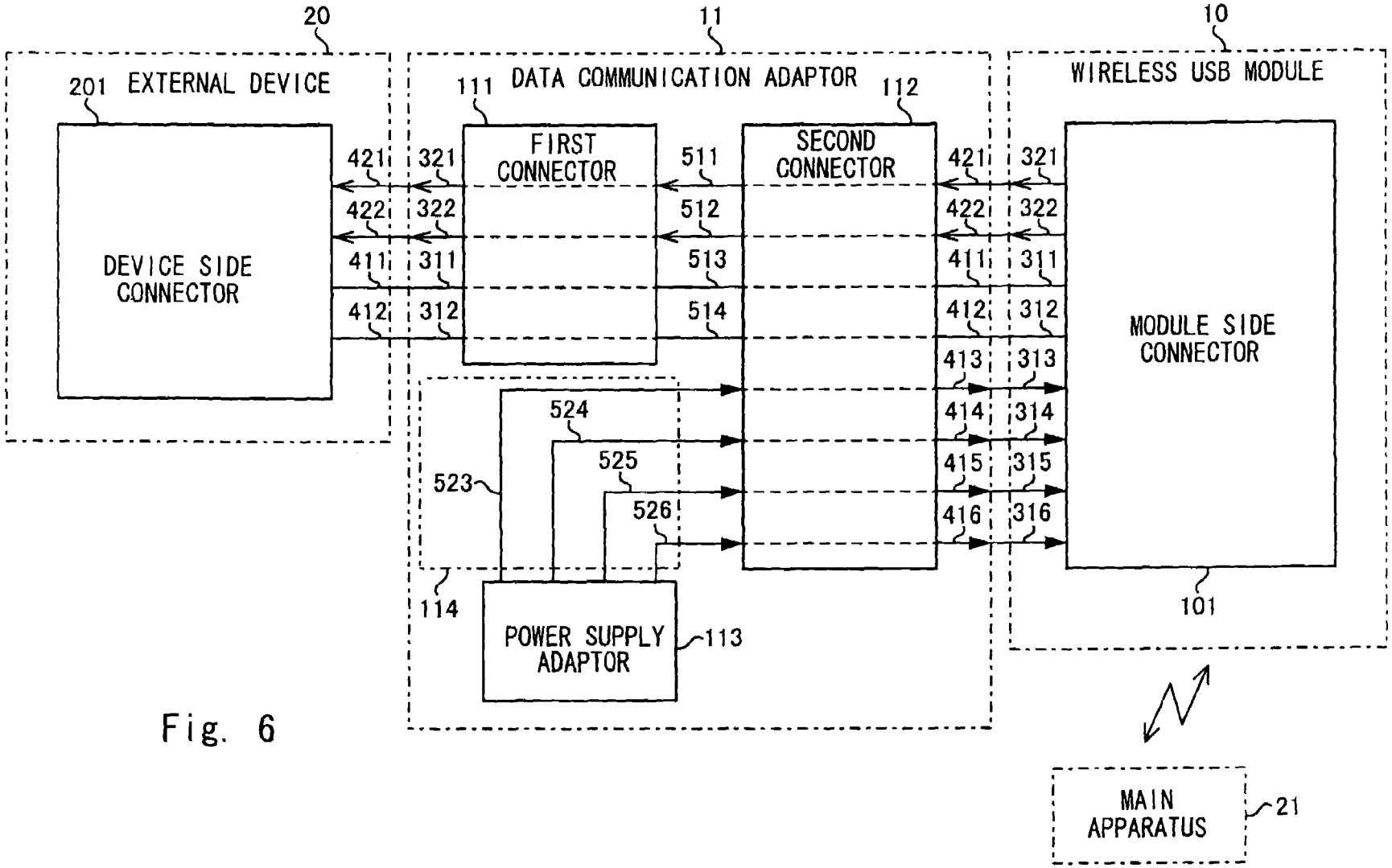
FIG. 6 is a block diagram of an internal configuration of the wireless communication module of the first embodiment.

Referring to FIGS. 1 to 6, a wireless communication module according to a first embodiment of the present invention is described. FIG. 1 is a schematic perspective view of the wireless communication module. FIG. 2 is a schematic plan view of a connector of a data-communication adaptor. FIG. 3 is a schematic plan view of the connector of the data-communication adaptor. FIG. 4 is a schematic plan view of a connector of an external device. FIG. 5 is a schematic plan view of a connector of the wireless communication module. FIG. 6 is a block diagram of an internal configuration of the wireless communication module.

As shown in FIG. 1, a wireless communication module 1 includes a wireless USB module 10 and an adaptor 11.

The wireless USB module 10 performs wireless communications based on various data communication standards. The wireless USB module 10 performs wireless communications based on USB standard. In this embodiment, the wireless USB module 10 and the adaptor 11 constitute the wireless communication module 1.

The wireless USB module 10 has various functional parts such as a control circuit or an interface similar to general modules. Incidentally, detailed description of its configuration is omitted here. The wireless USB module 10 includes a connector (module side connector) 101. The connector 101 is a module side connector, and its configuration differs from a general connector configuration compliant with the USB standard.

The adaptor 11 is connected to an external device 20 and the wireless USB module 10. The adaptor 11 is a data-communication adaptor to realize data communications between the external device 20 and the wireless USB module 10. The adaptor 11 includes a connector (first connector) 111 and a connector (second connector) 112, which have different configurations as described later.

The external device 20 is a device such as a hard disk drive, a printer, a scanner, a keyboard, a mouse, or the like, which can perform communications based on the USB standards. The external device 20 includes a connector (device side connector) 201. The connector 201 is a device side connector connectable with a external device through a general USB cable or the like. That is, the connector 201 has the configuration based on the USB standard.

As described above, the connector 101 does not have the configuration based on the USB standard. On the other hand, the connector 201 has the configuration based on the USB standard. Thus, in this embodiment, the external device 20 cannot be directly connected to the wireless USB module 10. Therefore, the external device 20 and the wireless USB module 10 need to be connected via the adaptor 11. Incidentally, it is assumed that the external device 20 is equipped with a power supply unit (not shown) which supplies power independently of the wireless communication module 1.

The main apparatus 21 is a device such as a general PC (Personal Computer), a cell phone, a portable terminal device, or the like, which can perform communications based on the USB standards. The main apparatus 21 includes a wireless USB module communicable with the wireless USB module 10. Further, a module (not shown) similar to the above wireless USB module 10 may be connected to a connector (not shown) of the main apparatus 21 to thereby establish communications between the main apparatus 21 and the wireless USB module 10.

The wireless communication module 1 is attached to the external device 20. The adaptor 11 is previously attached to the wireless USB module 10.

The connector 101 of the wireless USB module 10 is plugged in the connector 112 of the adaptor 11. Further, the connector 111 of the adaptor 11 is plugged in the connector 201 of the external device 20. The data communications can be performed between the wireless USB module 10 and the external device 20. The wireless communication module 1, which is connected to the external device 20, communicates with the main apparatus 21 by radio. Then, the external device 20 performs wireless data communications with the main apparatus 21 through the wireless communication module 1.

Referring to FIG. 1 and optionally to FIGS. 2 and 3, the configuration of the adaptor 11 is described in detail.

As shown in FIG. 1, the adaptor 11 includes a power supply adaptor 113, a power cable 114, and a housing 115 as well as the connector 111 and the connector 112.

The connector 111 has the configuration based on the USB standard. FIG. 2 is a schematic plan view of the connector 111. As shown in FIG. 2, the connector 111 is a B-plug connector prescribed by the USB standard.

More specifically, the connector 111 includes power supply input terminals 311 and 312, and signal terminals 321 and 322 prescribed by the USB standard. The power supply input terminals 311 and 312, and the signal terminals 321 and 322 are arranged on an inner wall surface of a resin portion 33. The resin portion 33 has an insulating property. Further, the resin portion 33 is surrounded by a metal shield 34. In other words, the resin portion 33 is provided along an inner wall surface of the metal shield 34. A hollow portion is defined in the resin portion 33 so as to receive the B-receptacle connector. The terminals 311, 312, 321, and 322 are exposed at the inner wall surface of the hollow portion. The metal shield 34 is fixed to a casing 35.

The connector 112 has a configuration different from the configuration compliant with the USB standard. FIG. 3 is a schematic plan view of the connector 112. As shown in FIG. 3, the connector 112 is an extended one of the B-receptacle connector prescribed by the USB standard. To be specific, the connector 112 includes an additional terminal other than the configuration of the B-receptacle connector prescribed by the USB standard.

More specifically, the connector 112 includes power supply input terminals 413, 414, 415, and 416 as additional terminals other than the power supply input terminals 411 and 412, and the signal terminals 421 and 422. The power supply input terminals 411 and 412 are provided on an upper surface of the resin portion 43, and the signal terminals 421 and 422 are provided on a lower surface of the resin portion 43. The resin portion 43 is an insulative portion surrounded by the metal shield 44.

The power supply input terminals 415 and 416 are provided on a side surface of the resin portion 43. The power supply input terminals 413 and 414 are provided on an inner wall surface of the metal shield 44. A slot that can receive the B-plug connector is formed between the resin portion 43 and the metal shield 44. The terminals 411 to 416, 421, and 422 are exposed at each surface. The metal shield 44 is fixed to the casing 45.

The power supply adaptor 113 has a plug that is to be inserted to a general socket. The power cable 114 electrically connects the power supply adaptor 113 and the connector 112. In other words, the power supply adaptor 113 and the power cable 114 constitute a power supply unit for supplying power. The housing 115 shields terminals of the connectors 111 and 112 from the outside and protects connection portions between the terminals and the power cable 114 against damage.

The adaptor 11 has the following connection structure in the housing 115. That is, the power supply input terminals 311 and 312 of the connector 111 are connected to the power supply input terminals 411 and 412 of the connector 112, respectively. The signal terminals 321 and 322 of the connector 111 are connected with the signal terminals 421 and 422 of the connector 112, respectively. The power supply input terminals 413 to 416 of the connector 112 are connected to a plug of the power supply adaptor 113 through the power cable 114.

Subsequently, physical configurations of the connector 101 of the wireless USB module 10 and the connector 201 of the external device 20 are described in detail with reference to FIGS. 4 and 5.

FIG. 4 is a schematic plan view of the connector 101 of the wireless USB module 10. As shown in FIG. 4, the connector 101 is an extended one of the B-plug connector prescribed by the USB standard. To be specific, the connector 101 includes an additional terminal other than the configuration of the B-plug connector prescribed by the USB standard.

More specifically, the connector 101 includes power input terminals 313, 314, 315, and 316 as additional terminals other than the power supply input terminals 311 and 312, and the signal terminals 321 and 322 prescribed by the USB standard. The power supply input terminals 311 and 312, and the signal terminals 321 and 322 are arranged on an inner wall surface of the resin portion 33. The power input terminals 313 and 314 are provided on upper and lower outer wall surfaces of the resin portion 33. The power input terminals 315 and 316 are arranged on an inner wall surface of the resin portion 33. The resin portion 33 is surrounded by the metal shield 34. A hollow portion is defined in the resin portion 33 so as to receive the B-receptacle connector. The terminals 311 to 316, 321, and 322 are exposed at each surface. The metal shield 34 is fixed to the casing 35.

FIG. 5 is a schematic plan view of the connector 201 of the external device 20. As shown in FIG. 5, the connector 201 is a B-receptacle connector prescribed by the USB standard.

To be specific, the connector 201 includes power input terminals 411 and 412, and signal terminals 421 and 422. The power input terminals 411 and 412 are provided on an upper surface of the resin portion 43. The signal terminals 421 and 422 are provided on a lower surface of the resin portion 43. The resin portion 43 is surrounded by the metal shield 44. A slot that receives the B-plug connector is formed between the resin portion 43 and the metal shield 44. The terminals 411, 412, 421, and 422 are exposed at each surface. The metal shield 44 is fixed to the casing 45.

Referring to FIG. 6, electrical configuration of the wireless communication module 1 is described next. FIG. 6 is a block diagram of the internal configuration of the wireless communication module 1. Incidentally, in the illustrated example of FIG. 6, power is input/output along directions indicated by the black solid arrows. Further, signals are input/output upon data transmission from the main apparatus 21 to the external device 20 along directions indicated by arrows other than the black solid arrows. Incidentally, in the case of transmitting data from the external device 20 to the main apparatus 21, the data is transmitted in opposite direction.

As shown in FIG. 6, the connector 201 of the external device 20 is connected to the connector 111 of the adaptor 11. To be specific, the power input terminals 411 and 412 of the connector 201 are connected to the power supply input terminals 311 and 312 of the connector 111, respectively. The signal terminals 421 and 422 of the connector 201 are connected to the signal terminals 321 and 322 of the connector 111, respectively.

The connector 101 of the wireless USB module 10 is connected to the connector 112 of the adaptor 11. To be specific, the power supply input terminals 311 and 312 of the connector 101 are connected to the power input terminals 411 and 412 of the connector 112, respectively. The power input terminals 313 to 316 of the connector 101 are connected to the power supply input terminals 411 to 416 of the connector 112, respectively. The signal terminals 321 and 322 of the connector 101 are connected to the signal terminals 421 and 422 of the connector 112, respectively.

Further, in the adaptor 11, the terminals 311, 312, 321, and 322 of a first connector 111 are connected to the terminals 411, 412, 421, and 422 of a second connector 112, respectively through lines 511 to 514.

As shown in FIG. 6, the power cable 114 includes power supply lines 523, 524, 525, and 526 connected to the plug of the power supply adaptor 113. The power supply lines 523 to 526 are connected to the power supply input terminals 413 to 416 of the connector 112, respectively.

The wireless USB module 10 performs the following operations. When the plug of the power supply adaptor 113 is inserted to a power receptacle, power is supplied to the wireless communication module 10 through the adaptor 11. The power supplied via the plug of the power supply adaptor 113 is transferred to the power supply input terminals 413 to 416 of the connector 112 through the power supply lines 523 to 526. The power supply input terminals 313 to 316 of the connector 101 are supplied with the power output from the power supply input terminals 413 to 416 of the connector 112. As a result, the power is supplied to the wireless USB module 10, and the wireless USB module 10 is ready for operation. Incidentally, in this example, the power supply input terminals 411 and 412 of the connector 201 are not used. Thus, the external device 20 does not supply power to the wireless USB module 10.

The wireless USB module 10 establishes communications between the external device 20 and the main apparatus 21 as follows.

The main apparatus 21 transmits data to the wireless USB module 10. The wireless USB module 10 outputs data to the connector 112 of the adaptor 11 from the signal terminals 321 and 322. The data output from the wireless USB module 10 is input to the signal terminals 421 and 422 of the connector 112. Then, the connector 111 outputs the input data from the signal terminals 321 and 322. The output data is input to the signal terminals 421 and 422 of the connector 201 of the external device 20. Hence, data can be transmitted from the main apparatus 21 to the external device 20.

The external device 20 outputs data to the wireless USB module 10. The data output from the external device 20 is input to the adaptor 11 through the signal terminals 321 and 322 of the connector 111. The adaptor 11 outputs the data input from the external device 20 through the signal terminals 421 and 422 of the connector 112. The wireless USB module 10 accepts the data from the adaptor 11 through the signal terminals 321 and 322 of the connector 101. In this way, the external device 20 can transmit data to the main apparatus 21.

As described above, in the wireless communication module 1 of this embodiment, the adaptor 11 supplies power to the wireless USB module 10. Hence, it is unnecessary to provide the wireless USB module 10 with a power supply unit, so portability (ease of transport) of the wireless USB module 10 is improved.

Incidentally, the connector 201 of the external device 20 can be arbitrarily configured. Even if the connector configuration of the external device 20 is changed, the adaptor 11 can follow the change with ease. Thus, it is possible to prevent deterioration in usability of the wireless USB module 10. To be specific, a connector having the same configuration as that of the connector 112 of FIG. 3 may be provided to the external device 20. That is, the adaptor 11 can suit to not only the external device 20 of the connector 201 but also the external device 20 of the connector 112 of FIG. 3. In this case, the wireless USB module 10 can be directly connected to the connector of the external device 20 not through the adaptor 11.

Further, the wireless USB module 10 can be provided at a low price. In general, a manufacturer of the wireless USB module 10 needs to sell the wireless USB module 10 and an external power supply device that supplies power thereto (a power supply adaptor, a battery, or the like) as a pair. The adaptor 11 of this embodiment can supply power to the wireless USB module 10, so the power supply adaptor can be omitted. Therefore, the wireless USB module 10 can be provided at a low price, and a user can purchase a low-priced module. Further, since the adaptor 11 conforms to the USB standard, the user can purchase the wireless USB module 10 regardless of a manufacturer. Hence, the user can buy a new wireless USB module 10 with ease.

Further, a developer of the wireless USB module 10 can save development costs of the wireless USB module 10. In general, if a power supply adaptor supplying power to the wireless USB module 10 needs to be additionally provided, components connected to the power supply adaptor should be held in the wireless USB module 10. Hence, development costs of the wireless USB module 10 increase. In contrast, the power supply adaptor is unnecessary for the adaptor 11 of this embodiment, so it is unnecessary to hold the components connected to the power supply adaptor. As a result, cost increases can be suppressed.

Second Embodiment

In the first embodiment, the adaptor 11 only supplies power to the wireless USB module 10. In contrast, according to a second embodiment of the present invention, the adaptor 11 supplies power to the external device 20 as well as the wireless USB module 10.

Figure 7:
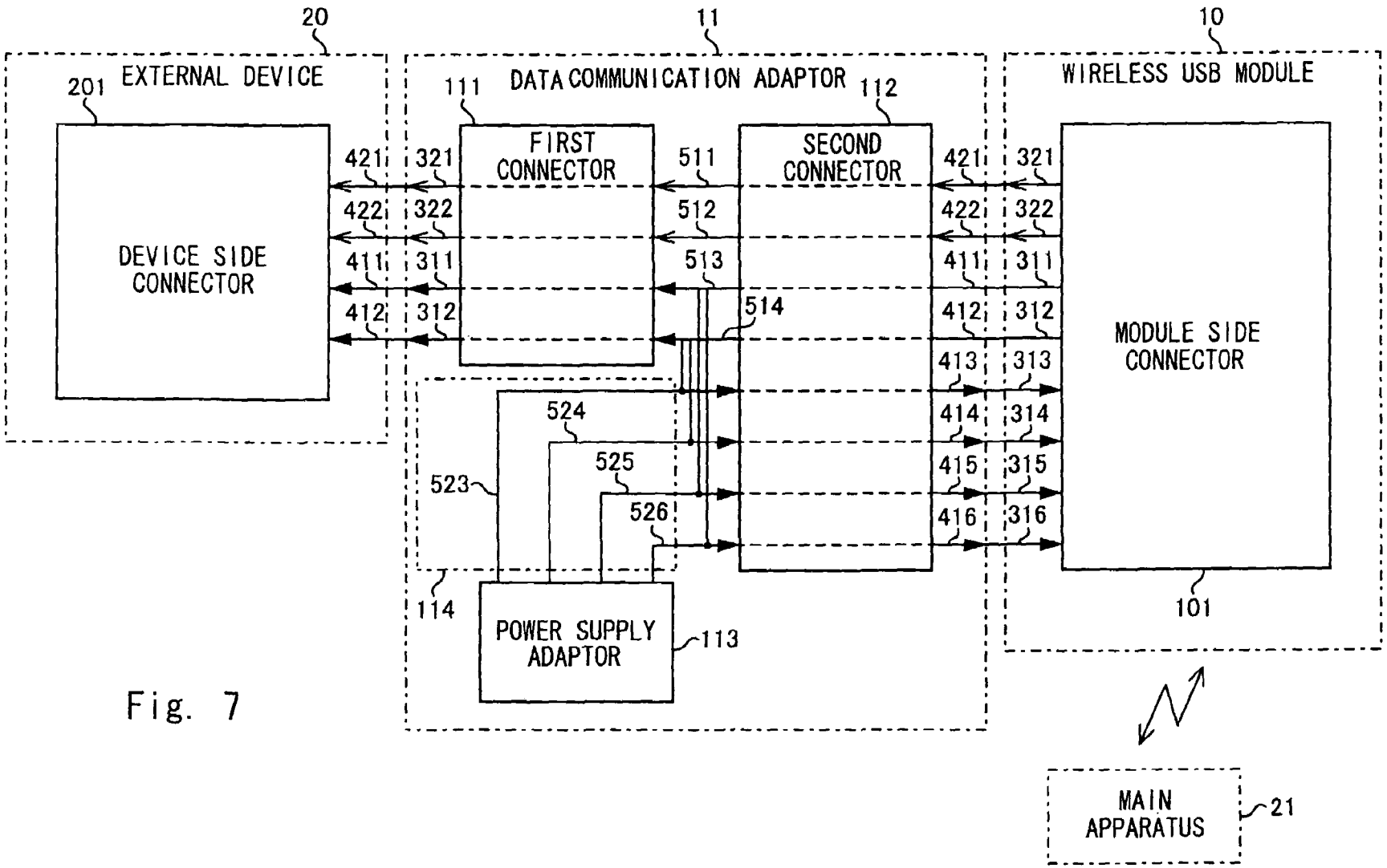
FIG. 7 is a block diagram of an internal configuration of a wireless communication module according to a second embodiment of the present invention.

FIG. 7 is a block diagram of the internal configuration of the wireless communication module 1 of the second embodiment. Incidentally, in the illustrated example of FIG. 7, power input/output is indicated by the solid black arrows, and signal input/output is indicated by arrows other than the solid black arrows.

As shown in FIG. 7, in the adaptor 11 of this embodiment, the power cables 523 and 524 are connected to the power supply input terminal 312 of the connector 111. The power cables 525 and 526 are connected to the power supply input terminal 311 of the connector 111.

In such configuration, power supplied from the power supply adaptor 113 is output from the power supply input terminals 311 to 312 of the connector 111 through the power supply lines 523 to 526. The power output from the connector 111 is connected to the power supply input terminals 411 and 412 of the connector 201. As a result, the external device 20 can operate in accordance with the power supplied through the adaptor 11.

As described above, according to this embodiment, the power supply input terminals 411 and 412 of the connector 201 can be effectively used, and it is possible to respond to the case where external device 20 includes no power supply unit. Thus, usability such as portability of the external device 20 can be improved.

Third Embodiment

In the second embodiment, the adaptor 11 directly supplies power to the external device 20. In contrast, according to a third embodiment of the present invention, the adaptor 11 supplies power to the external device 20 through the wireless USB module 10.

Figure 8:
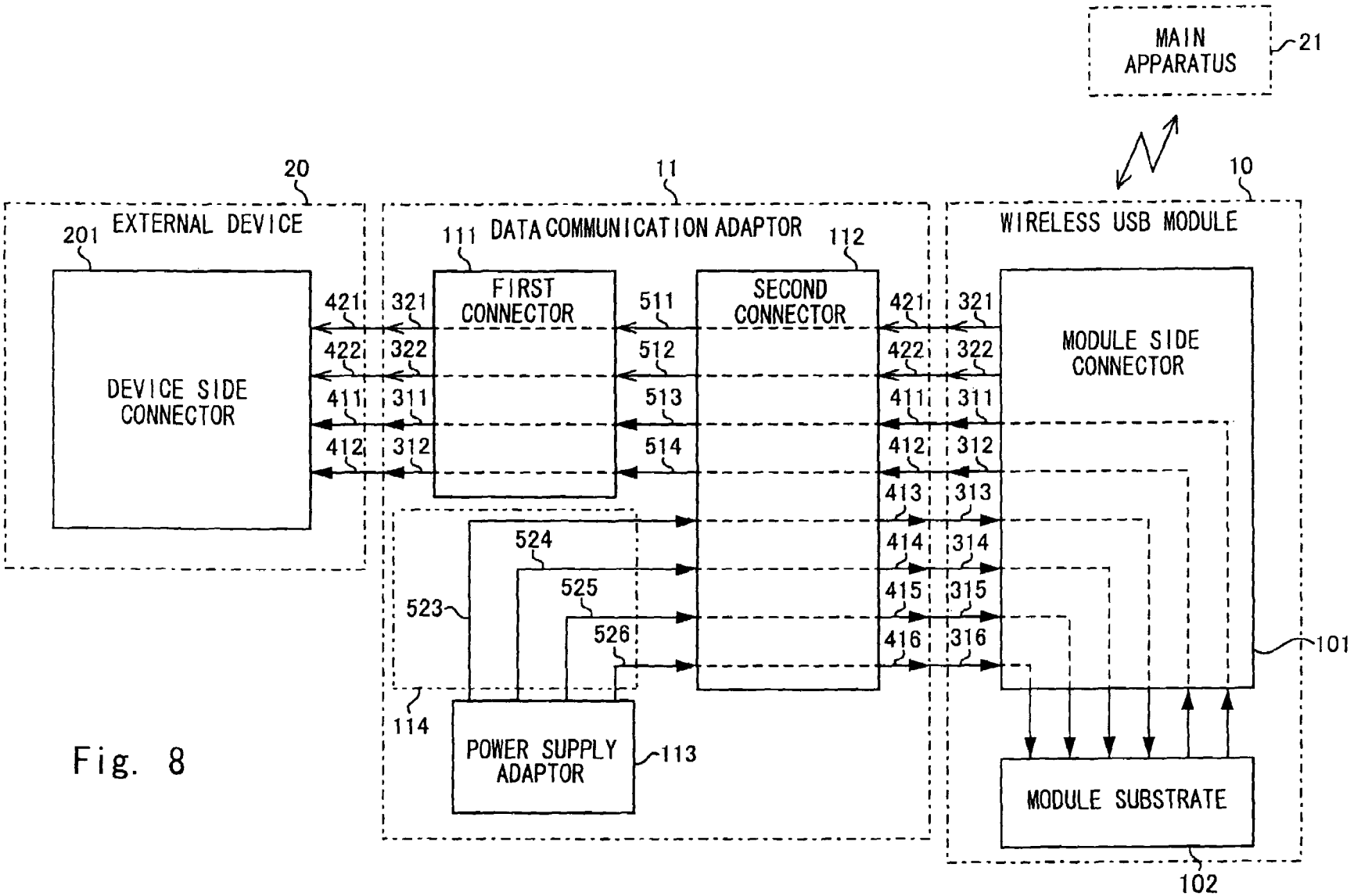
FIG. 8 is a block diagram of an internal configuration of a wireless communication module according to a third embodiment of the present invention.

FIG. 8 is a block diagram of the internal configuration of the wireless communication module 1 of this embodiment. Incidentally, in the illustrate example of FIG. 8, power input/output is indicated by the solid black arrows, and signal input/output is indicated by arrows other than the solid black arrows.

As shown in FIG. 8, the adaptor 11 of this embodiment has the same configuration as that of the adaptor 11 of the first embodiment. In contrast, the wireless USB module 10 includes a module substrate 102 in addition to the connector 101. The module substrate 102 is connected to the power supply input terminals 311 to 316 of the connector 101. To elaborate, the power supply input terminals 313 and 314 are connected to the power supply input terminal 311 through the module substrate 102. The power supply input terminals 315 and 316 are connected to the power supply input terminal 312 through the module substrate 102.

In such configuration, power is supplied to the external device 20 through the wireless USB module 10. More specifically, the power supplied from the power supply adaptor 113 is output from the power supply input terminals 413 to 416 of the connector 112 through the power supply lines 523 to 526. The output power is input to the power supply input terminals 313 to 316 of the connector 101. The input power is applied from the connector 101 to the module substrate 102 through the power supply input terminals 313 to 316. The module substrate 102 outputs the power to the connector 101.

The output power from the module substrate 102 is input from the power supply input terminals 311 and 312 of the connector 101 to the power supply input terminals 411 and 412 of the connector 112. The input power is supplied to the connector 111 through the lines 513 and 514. The connector 111 outputs power from the power supply input terminals 311 and 312. The output power is input to the external device 20 via the power supply input terminals 411 and 412 of the connector 201. Hence, the external device 20 is supplied with power and can operate.

As described above, according to this embodiment, the power supply input terminals 311 and 312 of the connector 101 can be effectively used, and it is possible to respond to the case where the external device 20 includes no power supply unit. As a result, usability such as portability of the external device 20 can be improved.

Incidentally, the first and second embodiments describe an example where the external device 20 communicates with the wireless USB module 10 by use of the adaptor 11. The adaptor 11 is applicable to the main apparatus 21 as well as the external device 20. Incidentally, any other pair of plug connector and receptacle connector can be used as long as the adaptor 11 can supply power to the wireless USB module.

Incidentally, in the second embodiment, power is supplied to the external device 20 through the adaptor 11. Moreover, in the third embodiment, power is supplied to the external device 20 through the adaptor 11 and the wireless USB module 10 in this order. A power supply path is not limited to the above, and power may be supplied to the external device 20 through the adaptor 11. The second and third embodiments may be combined.

It is apparent that the present invention is not limited to the above embodiments but may be modified and changed without departing from the scope and spirit of the invention.

What is claimed is:

1. An adaptor connectable between a communication module and an external device that normally do not supply electrical power to each other, the adaptor comprising:

a first connector configured based on a USB (Universal Serial Bus) plug connector prescribed by the USB standard to which a connector of the external device is coupled, including a plurality of first signal terminals and first power supply output terminals being arranged at the first connector;

a second connector configured based on an extended USB receptacle connector prescribed by the USB standard to which a connector of the communication module is coupled, a plurality of second signal terminals, second power supply input terminals and second power supply output terminals as additional terminals being arranged at the second connector;

data lines through which data is transferrable between the external device and the communication module, first ends of the data lines connected to the first signal terminals and second ends of the data lines connected to the second signal terminals;

power lines through which power is transferrable from the communication module to the external device, one end of the power lines connected to the second power supply input terminals, the other ends of the power lines connected to the first power supply output terminals;

power supply lines through which power is transferred from an external power supply to the communication module, the one ends of the power supply lines connected to the external power supply and the other ends connected to the second power supply output terminals.

2. The adaptor according to claim 1, wherein the power lines are electrically coupled to the power supply lines.

3. The adaptor according to claim 1, further comprising:

a housing by which the data and power lines are secured, the housing holding the first connector and the second connector; and a cable surrounding at least part of the power supply lines and connected to the housing.

4. The adaptor according to claim 1, wherein a number of the terminals at the first connector is smaller than a number of the terminals at the second connector.

5. The adaptor according to claim 1, wherein the first connector is connectable directly to the external device whose connector is a USB receptacle connector prescribed by the USB standard and the second connector is connectable directly to the communication module whose connector is an extended USB plug connector prescribed by the USB standard.

6. The adaptor according to claim 1, further comprising a housing that includes the first connector at an end thereof and the second connector at another end thereof.

7. A wireless communication unit comprising:

a communication module, a connector of which comprises an extended USB plug connector prescribed by USB standard, receiving electrical power from the connector; and an adaptor through which the communication module is attached to an external device that communicates with the main device through the communication module, the external device and the communication module not normally capable of supplying power to each other, the adaptor comprising:

a first connector configured based on USB plug connector prescribed by the USB standard to which a connector of the external device is coupled, a plurality of first signal terminals and first power supply output terminals being arranged at the first connector;

a second connector configured based on the extended USB receptacle connector prescribed by the USB standard to which a connector of the communication module is coupled, a plurality of second signal terminals, second power supply input terminals and second power supply output terminals as additional terminals being arranged at the second connector;

data lines through which data is transferrable between the external device and the communication module, first ends of the data lines connected to the first signal terminals and second ends of the data lines connected to the second signal terminals;

power lines through which power is transferrable from the communication module to the external device, one end of the power lines connected to the second power supply input terminals, the other ends of the power lines connected to the first power supply output terminals;

power supply lines through which power is transferred from an external power supply to the communication module, the one ends of the power supply lines connected to the external power supply and the other ends connected to the second power supply output terminals.

8. The wireless communication unit according to claim 7, wherein the power lines are electrically coupled to the power supply line.

9. The wireless communication unit according to claim 7, the adaptor further comprising:

a housing by which the data and power lines are secured, the housing holding the first connector and the second connector; and a cable surrounding at least part of the power supply lines and connected to the housing.

10. The wireless communication unit according to claim 7, wherein a number of the terminals at the first connector is smaller than a number of the terminals at the second connector.

11. The wireless communication unit according to claim 7, wherein the connector of the communication module includes signal terminals corresponding to the second signal terminals, power supply output terminals corresponding to the second power supply input terminals, and power supply input terminals corresponding to the second power supply output terminals.

12. The wireless communication unit according to claim 7, wherein the communication module includes a size which is less than a size of the external device.

13. The wireless communication unit according to claim 7, wherein the adaptor further comprises a housing that includes the first connector at an end thereof and the second connector at another end thereof.

14. The wireless communication unit according to claim 7, wherein the power supply input terminals disposed in the connector of the communication module are coupled to the power supply output terminals disposed in the connector of the communication module via the inside of the wireless communication module.

* * * * *